US005418110A

United States Patent [19]

Uytterhoeven et al.

[11] Patent Number: 5,418,110

[45] Date of Patent: May 23, 1995

[54] DYE-IMAGE RECEIVING ELEMENT FOR USE ACCORDING TO THERMAL DYE SUBLIMATION TRANSFER

[75] Inventors: Herman J. Uytterhoeven, Bonheiden; Daniël M. Timmerman, Mortsel, both of Belgium; Harald Blum, Auf dem Westkamp, Germany

[73] Assignee: AGFA-GEVAERT, N.V., Mortsel, Belgium

[21] Appl. No.: 926,288

[22] Filed: Aug. 10, 1992

[30] Foreign Application Priority Data

Aug. 15, 1991 [EP] European Pat. Off. ..... 91202081

[51] Int. Cl.[6] ..... G03C 1/72; B41M 5/035

[52] U.S. Cl. ..... 430/200; 430/201; 503/227

[58] Field of Search ..... 525/375, 327.4, 327.6, 525/285; 430/200, 201; 503/227

[56] References Cited

U.S. PATENT DOCUMENTS

| | | | |
|---|---|---|---|
| 4,740,496 | 4/1988 | Vanier | 503/227 |
| 4,904,740 | 2/1990 | Blum et al. | 525/327.4 |
| 4,970,270 | 11/1990 | Blum et al. | 525/375 |
| 4,975,493 | 12/1990 | Blum et al. | 525/375 |
| 4,985,395 | 1/1991 | Vanmaele et al. | 503/227 |
| 5,028,582 | 7/1991 | Imai et al. | 503/227 |
| 5,045,600 | 9/1991 | Wamprecht et al. | 525/375 |
| 5,063,198 | 11/1991 | Imai et al. | 503/227 |
| 5,089,565 | 2/1992 | Blum et al. | 525/375 |
| 5,135,987 | 8/1992 | Wamprecht et al. | 525/375 |
| 5,145,827 | 9/1992 | Imai et al. | 503/227 |

FOREIGN PATENT DOCUMENTS

| | | |
|---|---|---|
| 0336394 | 10/1989 | European Pat. Off. . |
| 0346669 | 12/1989 | European Pat. Off. . |
| 0402898 | 12/1990 | European Pat. Off. . |

*Primary Examiner*—Charles L. Bowers, Jr.
*Assistant Examiner*—Martin J. Angebranndt
*Attorney, Agent, or Firm*—Breiner & Breiner

[57] ABSTRACT

Dye-image receiving element for use according to thermal dye sublimation transfer comprising a support having thereon a dye-image receiving layer and optionally a toplayer wherein the dye-image receiving layer or the toplayer comprises the cured product of a moisture-curable binder composition prepared by mixing the following components (A) and (B):

(A) 30 to 99 parts by weight of at least one copolymer of olefinically unsaturated compounds having a weight-average molecular weight [Mw] of at least 1500 and containing chemically incorporated moieties capable of undergoing an addition reaction with amino groups, and (B) 1 to 70 parts by weight of organic substances containing blocked amino groups from which substances under the influence of moisture compounds having free primary and/or secondary amino groups are formed, wherein i) the copolymers of component (A) contain intramolecularly bound carboxylic anhydride moieties, with the anhydride equivalent weight of the copolymers being from 196 to 9800 and ii) the binder composition contains from 0.25 to 10 anhydride moieties for each blocked amino group.

10 Claims, No Drawings

DYE-IMAGE RECEIVING ELEMENT FOR USE ACCORDING TO THERMAL DYE SUBLIMATION TRANSFER

DESCRIPTION

1. Field of the Invention

The present invention relates to dye-image receiving elements for use according to thermal dye sublimation transfer.

2. Background of the Invention

Thermal dye sublimation transfer also called thermal dye diffusion transfer is a recording method in which a dye-donor element provided with a dye layer containing sublimable dyes having heat transferability is brought into contact with a dye-image receiving element and selectively, in accordance with a pattern information signal heated with a thermal printing head provided with a plurality of juxtaposed heat-generating resistors, whereby dye from the selectively heated regions of the dye-donor element is transferred to the dye-image receiving element and forms a pattern thereon, the shape and density of which is in accordance with the pattern and intensity of heat applied to the dye-donor element.

A dye-image receiving element for use according to thermal dye sublimation transfer usually comprises a support e.g. paper or a transparent film, coated with a dye-image receiving layer into which the dye can diffuse more readily. An adhesive layer may be provided between the support and the receiving layer. On top of said receiving layer a separate release layer may be provided to improve the releasability of the receiving element from the donor element after transfer is effected As resins constituting the dye-image receiving layer there are known various thermoplastic resins such as polycarbonates, polyurethanes, polyesters, polyamides, polyvinylchlorides, poly(styrene-co-acrylonitriles), polycaprolactones or mixtures thereof and various cross-linked heat-cured or radiation-cured resins such as described in, for example, EP 394460 and JP 90/95891.

Dye-image receiving layers comprising moisture-cured resins are also known. Moisture-curable resins are most suitable in the aspect of image stability because they leave little unreacted resin on the surface of the receiving layer.

In EP 336394 and EP 402898 resins having a hydrolyzable silyl, silanol and/or isocyanato group at the end of the molecular chain or in the side chain are used as moisture-curable resins for the image receiving layer or toplayer on top of the image receiving layer.

However isocyanate groups are highly toxic and therefore are to be avoided. Moisture-curable resins containing hydrolyzable silyl or silanol groups have the disadvantage of low curing speed requiring high temperatures. Curing conditions mentioned in EP 336394 are: 100° C. for 1 hour.

SUMMARY OF THE INVENTION

It is an object of the present invention to provide a moisture-cured dye image-receiving layer or toplayer not having the disadvantages mentioned above.

The present invention provides a dye-image receiving element for use according to thermal dye sublimation transfer comprising a support having thereon a dye-image receiving layer comprising the cured product of a moisture-curable binder composition prepared by mixing the following components (A) and (B):

(A) 30 to 99 parts by weight of at least one copolymer of olefinically unsaturated compounds having a weight-average molecular weight [Mw] of at least 1500 and containing chemically Incorporated moieties capable of undergoing an addition reaction with amino groups and (B) 1 to 70 parts by weight of organic substances containing blocked amino groups from which substances under the influence of moisture compounds having free primary and/or secondary amino groups are formed, wherein i) the copolymers of component (A) contain intramolecularly bound carboxylic anhydride moieties, with the anhydride equivalent weight of the copolymers being from 196 to 9800 and ii) the binder composition contains from 0.25 to 10 anhydride moieties for each blocked amino group.

The present invention also provides a dye-image receiving element for use according to thermal dye sublimation transfer comprising a support having thereon, in order, a dye-image receiving layer and a toplayer wherein the toplayer comprises the cured product of the moisture curable binder composition prepared by mixing the components (A) and (B) as defined above.

The binder product obtained in curing the above-defined binder composition with the aid of water (moisture) results from the hydrolysis of the blocked amino moieties of component (B), whereby one hydroxyl group is formed per amino group (primary or secondary amino group). These groups, especially said amino groups, enter into rapid cross-linking reaction with the anhydride groups of copolymer (A).

The curing speed of the moisture-curable binder composition according to the present invention is higher than the curing speed of the moisture-curable resins having a hydrolyzable silyl or silanol group known in the art as binder for the receiving layer or toplayer, yielding a more complete curing during the time needed to dry the layer even for relatively thick layers such as the receiving layer. It is thus not necessary to provide a multilayered arrangement that is more cumbersome to manufacture than a one layer constitution and that leads to increase of cost, with a thin moisture-cured layer on top to obtain reasonable curing times, as described in EP 402898.

A separate toplayer containing the moisture-cured product according the present invention can be provided in order to improve the release of the receiving element from the donor element after transfer is effected. This toplayer may then also comprise a releasing agent.

DETAILED DESCRIPTION OF THE INVENTION

According to a preferred embodiment, the binder composition used according to the present invention is obtained by mixing:

(A) 50 to 97 parts by weight of (a) copolymer(s) of maleic anhydride with at least one other olefinically unsaturated monomer, said copolymer containing addition polymerized maleic anhydride units and having a weight-average molecular weight (Mw) of 1500 to 75000, and (B) 3 to 50 parts by weight of at least one organic substance containing blocked amino groups and having a molecular weight of 86 to 10000, wherein component (A) consists essentially of a copolymer of:

a) 3 to 25 parts by weight of maleic anhydride, and b) 75 to 97 parts by weight of at least one copolymerisable monomer selected from the group corresponding to the following general formulae (I), (II) and (III):

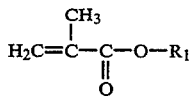

(I)

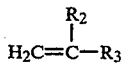

(II)

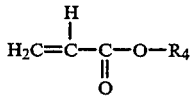

(III)

wherein:

each of $R_1$ and $R_4$ independently of each other represents an aliphatic or cycloaliphatic $C_1$–$C_{22}$ hydrocarbon group in which one or more carbon atoms may be replaced by heteroatoms selected from the group consisting of oxygen, sulphur and nitrogen; a fluoroalkyl group; a perfluoroalkyl group or a polydialkylsiloxane group;

$R_2$ represents hydrogen, methyl, ethyl, chlorine, fluorine or an alkoxy group;

$R_3$ represents a $C_2$–$C_{22}$ aliphatic hydrocarbon group; a $C_5$–$C_{10}$ cycloaliphatic hydrocarbon group; a $C_6$–$C_{12}$ aromatic hydrocarbon group (including an aryl aliphatic group) and in each of these three hydrocarbon groups (aliphatic, cycloaliphatic and aromatic) possibly one or more carbon atoms may be replaced by heteroatoms selected from the group consisting of oxygen, sulphur and nitrogen in the form of ether, ester, amide, urethane, urea, thioester, oxirane, ketone, lactam or lactone group; a fluoroalkyl group; a perfluoroalkyl group; a polydialkylsiloxane group; a nitrile group; chlorine; and wherein component (1) is a compound selected from the group consisting of an aldimine, ketimine, oxazolane, hexahydropyrimidine, tetrahydropyrimidine, tetrahydroimidazole, amide acetal and amide aminal.

Examples of copolymerisable monomers corresponding to formulae (I), (II) or (III) are: methyl(meth)acrylate, ethyl(meth)acrylate, propyl(meth)acrylate, butyl(meth)acrylate, 2-ethylhexyl(meth)acrylate, lauryl(meth)acrylate, hexadecyl(meth)acrylate, stearyl(meth)acrylate, glycidyl(meth)acrylate, hexanediol bisacrylate, (meth)acrylonitrile, butadiene, isoprene styrene, α-methylstyrene, methoxystyrene, vinyltoluene, vinylacetate, vinylpropionate, vinylbutyrate, vinyllaurate, vinylpalmitate, vinylstearate, vinyleicosate, vinyldocosate, vinylchloride, vinylidenechloride, vinylpyridine, N-vinylpyrrolidone, vinylnaphthalene, vinylpyridine, triethyleneglycol monomethylether mono(meth)acrylate, heptadecafluorodecylmeth)acrylate and polydimethylsiloxane mono(meth)acrylate.

Depending on the nature of the copolymerisable monomers and their weight ratio in the copolymer (A) the properties of the layer containing the moisture-cured binder according to the present invention can be influenced. Thus in operating monomers such as butylacrylate and 2-ethylhexylacrylate in the copolymer (A) will decrease the glass transition temperature of the copolymer (A) yielding a relatively soft layer and will improve the film forming properties of the copolymer (A); incorporating monomers such as styrene and acrylonitrile will increase the glass transition temperature yielding a relatively hard layer; incorporating monomers such as vinylstearate or stearylmethacrylate or polydimethylsiloxane monoacrylate will improve the release properties of the layer; incorporating monomers containing a polyethyleneoxide chain will improve the antistatic properties of the layer. There can also be incorporated in the polymer (A) monomers that improve the light or ultraviolet or heat stability of the layer.

According to a particular embodiment the copolymer containing anhydride groups contains additionally epoxide groups as described in U.S. Pat. No. 4,904,740, wherein the last mentioned groups also take part in a crosslinking reaction with free amino groups.

Preferred maleic anhydride copolymers (A) have a weight-average molecular weight [Mw] determined by gel chromatography of 3000 to 50000. Their anhydride equivalent weight (=quantity in gram containing 1 mole of anhydride groups) is from 3800 to 393 and preferably from 2000 to 450.

They are produced in known manner by radically initiated copolymerisation, preferably in the presence of organic solvents. Suitable solvents for that purpose are given in U.S. Pat. No. 4,975,493 which also mentions detailed preparation examples of such copolymers. The radical formers applied in the copolymerisation process are those suitable for reaction temperatures of 60° to 180° C. such as organic peroxides and other radical formers mentioned in U.S. Pat. No. 4,975,493.

Preferred maleic anhydride copolymers for use according to the present invention contain styrene, methacrylate and/or acrylate units.

Preferably used blocked amines are oxazolanes, e.g. those described in said U.S. Pat. No. 4,975,493. Blocked amines containing aldimine or ketimine groups for generating free amino groups with water are described in U.S. Pat. No. 4,937,293. Blocked amines containing hexahydropyrimidine or tetrahydropyrimidine or tetrahydroimidazole moieties for generating free amino groups are described in U.S. Pat. No. 4,970,270. Blocked amines being amide acetal or amide aminal compounds are described in EP 146669.

The blocked amines representing said component (B) have preferably a molecular weight of from 86 to 10000, preferably from 250 to 4000 and contain a statistical average of from 1 to 50, preferably 1 to 10, especially 2 to 4 structural units corresponding to at least one of the following general formulae (IV), (V), (VI), (VII) and (VIII):

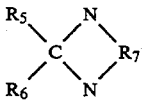

IV

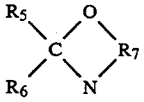

V

-continued

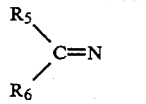

VI

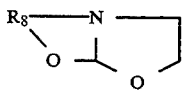

VII

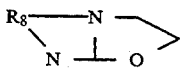

VIII wherein:

each of $R_5$ and $R_6$ independently of each other represents hydrogen, an aliphatic hydrocarbon group containing from 1 to 18 carbon atoms, a cycloaliphatic hydrocarbon group containing from 5 to 10 carbon atoms, an araliphatic hydrocarbon group containing from 7 to 18 carbon atoms or a phenyl group, or $R_5$ and $R_6$ represent together the necessary atoms to form a five- or six-membered cycloaliphatic ring with the carbon atom whereto they are commonly linked;

$R_7$ represents a divalent aliphatic hydrocarbon group containing 2 to 6 carbon atoms, but having only a chain of 2 to 3 carbon atoms between the defined heteroatoms of the ring;

$R_8$ represents a divalent aliphatic hydrocarbon group having 2 to 10 carbon atoms, but having only 2 or 3 carbon atoms between the heteroatoms whereto said group is linked.

Preparation examples of compounds within the scope of said general formulae are given in U.S. Pat. Nos. 4,975,493, 4,937,293, 4,970,270, and in EP 346669.

Suitable aldehydes or ketones for the preparation of the compounds B) containing hexahydropyrimidine or tetrahydropyrimidine or tetrahydroimidazole groups (formula IV) are, e.g. those corresponding to the following general formula:

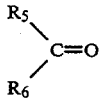

wherein $R_5$ and $R_6$ have the same meaning as described above, and preferably having a molecular weight of from 72 to 200 for the ketones, and from 58 to 250 for the aldehydes.

The following are examples of these compounds: methyl ethyl ketone, methyl propyl ketone methyl isopropyl ketone, methyl-n-butyl ketone, methyl-n-amyl ketone diethyl ketone, cyclohexanone, methyl-tert.-butyl ketone, 3,3,5-trimethyl-cyclohexanone, isobutyraldehyde, 2,2-dimethylpropanal, 1,2-ethylhexanal, hexanal, octanal, hexahydrobenzaldehyde.

The polyamines used for the preparation of the compounds containing hexahydropyrimidine or tetrahydropyrimidine or tetrahydroimidazole groups are in particular or organic compounds containing at least 2 primary and/or secondary amino groups.

Suitable polyamines are, e.g. those corresponding to the following general formula:

$$R_9—NH—R_7—NH—R_{10}$$

in which $R_7$ has the meaning indicated above, and each of $R_9$ and $R_{10}$ same or different) denote hydrogen, aliphatic hydrocarbon groups containing 1 to 10, preferably 1 to 4 carbon atoms, cycloaliphatic hydrocarbon groups containing 5 to 10, preferably 6 carbon atoms or aromatic hydrocarbon groups containing 7 to 15, preferably 7 carbon atoms, and the above-mentioned hydrocarbon groups, in particular the aliphatic hydrocarbon groups, may contain heteroatoms such as oxygen, nitrogen or sulphur in the form of ether, ester, amide, urethane, oxirane, ketone, lactam, urea, thioether, thioester or lactone groups, and may also contain reactive hydroxyl or amino groups.

Particularly preferred polyamines are those in which $R_9$ and $R_{10}$ (identical or different) stand for an alkyl group such as methyl, ethyl, n-propyl, isopropyl, n-butyl, isobutyl, tert.-butyl, n-pentyl or n-hexyl and at least one of the groups denoted by $R_9$ and $R_{10}$ is a group obtainable by the addition of an amine hydrogen atom to an olefinically unsatured compound. Examples of olefinically unsaturated compounds suitable for the preparation of such modified polyamines include derivatives of (methyl)acrylic acid such as the esters, amides or nitriles thereof or, e.g. aromatic vinyl compounds such as styrene, $\alpha$-methylstyrene or vinyl toluene or, e.g. vinyl esters such as vinyl acetate, vinyl propionate or vinyl butyrate or, for example, vinyl ethers such as ethyl vinyl ether, propyl vinyl ether, butyl vinyl ether or mono- or diesters for fumaric acid, maleic acid or tetrahydrophthalic acid.

$R_9$ and/or $R_{10}$ may also stand for an aminoalkyl or hydroxyalkyl group containing, e.g. 2 to 4 carbon atoms.

Ethylene diamine, 1,2-propylene diamine, 1,3-propylene diamine, 1,2- and 1,3-butylene diamine and diethylene triamine are particularly useful.

Compounds B) containing aldimine or ketimine groups (formula VI) in principle may be prepared from the aldehydes or ketones already mentioned above as examples. Preferred aldehydes and ketones used for this purpose include isobutyraldehyde, 2,2-dimethylpropanal, 2-ethylhexanal, hexahydrobenzaldehyde and especially those ketones which have a boiling point below 170° C. and are readily volatile at room temperature, e.g. methyl isobutyl ketone, methyl isopropyl ketone, diethyl ketone, diisobutyl ketone and methyl tert.-butyl ketone.

The polyamines used for the preparation of component B) containing ketimine or aldimine groups may in particular be organic compounds containing at least 2 aliphatically and/or cycloaliphatically bound primary amino groups. Although polyamines containing aromatically bound amino groups may also be used, they are less preferred. The polyamines generally have a molecular weight of from 60 to 500, preferably from 88 to 400, although prepolymers with a relatively high molecular weight containing amino end groups may also be used as polyamine components for the preparation of component B).

Diprimary aliphatic and cycloaliphatic diamines are particularly preferred polyamines, e.g. tetramethylene diamine, hexamethylene diamine, isophorone diamine, bis(4-amino-cyclohexyl)-methane, bis-aminomethylhexahydro-4,7-methanoindane, 1,4-cyclohexanediamine, 1,3-cyclohexane diamine, 2-methylcyclohexane diamine, 4-methylcyclohexane diamine, 2,2,5-trimethylhexane diamine, 2,2,4-trimethylhexane diamine, 1,4-butane diol -bis(3-aminpropyl)-ether, 2,5-diamine-2,5-dimethylhexane, bis-aminomethylcyclohexane, bis(4-amino-3,5-dimethylcyclohexyl)-methane and mixtures thereof.

Tetramethylene diamine, hexamethylene diamine, isophorone diamine, bis-aminomethyl-cyclohexane, 1,4-cyclohexane diamine, bis-aminomethylhexahydro-4,7-methanoindane and bis(4-amino-cyclohexyl)-methane are particularly preferred.

The aldimines and ketimines may be prepared not only from these preferred diamines but also from prepolymers containing primary amino end groups, i.e. compounds in the molecular weight range of from 500 to 5000, preferably from 500 to 2000, containing at least two amino end groups. These groups include, e.g. the amino polyethers known from polyurethane chemistry, such as these described, e.g. in EP 81701 or, e.g., compounds containing amide, urea, urethane or secondary amino groups obtained as reaction products of difunctional or higher functional carboxylic acids, isocyanates or epoxides with diamines of the type exemplified above, which reaction products still contain at least two primary amino groups. Mixtures of such relatively high molecular weight polyamines with the low molecular weight polyamines exemplified above may also be used.

The aromatic polyamines which in principle may be used for the preparation of the aldimines or ketimines but are less preferred include, e.g. 2,4- and 2,6-diaminotoluene, 1,4-diaminobenzene and 4,4'- diaminodiphenylmethane.

The compound (B) containing bicyclic amide acetal groups (formula VII) can be obtained in a manner known per se by reaction of compounds containing epoxy or cyclic carbonate groups with cyclic amino esters such as, for example, oxazolines or oxazines. Preferably, the starting components in this reaction are used in such relative amounts that a total of 1.0 to 1.1 oxazoline or oxazine groups is present for every epoxy or cyclic carbonate group. This type of reactions, which lead to compounds having bicyclic amide acetal groups, are described in detail, e.g. in R. Feinauer, Liebigs Ann. Chem. 698, 174 (1966).

The oxazolines or oxazines which are used for the preparation of the bicyclic amide acetals can be prepared by methods known from the literature, e.g. by reaction of carboxylic acids or anhydrides thereof with hydroxyamines with the elimination of water or by reaction of nitriles with hydroxyamines with the elimination of ammonia. This type of reactions is described, e.g. in J. Org. Chem. 26, 3821 (1961), H. L. Wehrmeister, J. Org. Chem. 27, 4418 (1962) and P. Allen, J. Org. Chem. 28, 2759 (1963).

Oxazolines or oxazines which contain hydroxyl groups can also be converted into higher-functional oxazolines or oxazines, e.g. by reaction with organic polyisocyanates.

Bicyclic amide aminals (formula VIII) which are suitable according to the invention as component B) can be obtained, e.g. by reaction of tetrahydropyrimidines or dihydroimidazoles with organic epoxides or cyclic carbonates.

In this reaction, monofunctional tetrahydropyrimidines or dihydroimidazoles can be reacted with monofunctional epoxides or carbonates, polyfunctional tetrahydropyrimidines or dihydroimidazoles with monofunctional epoxides or carbonates, monofunctional tetrahydropyrimidines or dihydroimidazoles with polyfunctional epoxides or carbonates.

The tetrahydropyrimidines or dihydroimidazoles used for the preparation of the bicyclic amide aminals can be prepared by methods known from the literature, e.g. by reaction of carboxylic acids with diamines with the elimination of water, or by reaction of nitriles with diamines with the elimination of ammonia. This type of reaction is described, e.g. in DE 3640239. For the preparation of polymeric dihydroimidazole compounds reference is made to GB 1221131.

Compounds containing oxazolane groups of the general formula V are especially preferred as component B).

Components B) containing oxazolane groups may be prepared in known manner by the reaction of the corresponding aldehydes or ketones corresponding to the following general formula ($R_5$ and $R_6$ having the meaning defined above):

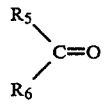

with suitable hydroxylamines of the type described hereinafter.

The aldehydes or ketones used may be selected from those already mentioned above as examples. Preferred aldehydes and ketones include isobutyraldehyde, 2-ethylhexanal, hexahydrobenzaldehyde, cyclopentanone, cyclohexanone, methylcyclohexanone, acetone, methyl ethyl ketone and methyl isobutyl ketone.

The hydroxylamines may be in particular organic compounds containing at least 1 aliphatic amino group and at least 1 aliphatically bound hydroxyl group. Although hydroxylamines containing aromatically or cycloaliphatically bound amino or hydroxyl groups may be used, they are less preferred. The hydroxylamines generally have a molecular weight of from 61 to 500, preferably from 61 to 300.

The following are examples of suitable hydroxylamines: bis(2-hydroxyethyl)-amine, bis(2-hydroxypropyl)-amine, bis(2-hydroxybutyl)amine, bis(3-hydroxypropyl)-amine, bis(3-hydroxyhexyl)-amine, N-(2-hydroxypropyl)-N-(2-hydroxyethyl)-amine, 2-(methylamino)-ethanol, 2-(ethylamino)-ethanol, 2-(propylamino)-ethanol, 2-(butylamino)-ethanol, 2-(hexylamino)-ethanol, 2-(cyclohexylamino)-ethanol, 2-amino-2-methyl1-propanol, 2-amino-2-ethyl-1-propanol, 2-amino-2-propyl-1-propanol, 2-amino-2-methyl-1,3-propanediol, 2-amino-3-methyl-3-hydroxybutane, propanolamine and ethanolamine.

The following are particularly preferred: bis(2-hydroxy-ethyl)amine, bis(2-hydroxypropyl)-amine, bis(2-hydroxy-butyl)-amine, bis(3-hydroxyhexyl)-amine, 2-(methylamino)-ethanol, 2-(ethylamino)-ethanol, 2-amino-2-methyl-1-propanol, 2-amino-2-ethyl-1-propanol, propanolamine and ethanolamine.

When component (B) contains oxazolane groups it can be prepared by allowing to react the above-defined reactants in such quantitative ratios that based on the carbonyl groups of the aldehydes or ketones, the hydroxylamines are present in 1 to 1.5 times the equivalent quantity in the oxazolan formation. Catalytic quantities of acidic substances, e.g. p-toluene sulfonic acid, hydrogen chloride, sulfuric acid or aluminium chloride, may be used to accelerate the reaction. A suitable reaction temperature is in the range of 60° to 180° C., the water formed in the reaction being removed by distillation using an entraining agent as described in U.S. Pat. No. 4,975,493.

To produce components (B) having in their molecule a plurality of oxazolane moieties, mono-oxazolanes according to the above mentioned general formula (V) are allowed to react through hydrogen on their nitrogen atom with a polyfunctional reactant, e.g. polyisocyanate, polyepoxide, polycarboxylic acid, partially esterified polycarboxylic acid or polyacid anhydride. The reaction with organic polyisocyanates is preferred and may be carried out as described in DE 2446438.

Examples of polyisocyanates which are suitable for this modifying reaction are aliphatic, cycloaliphatic, araliphatic, aromatic or heterocyclic polyisocyanates, such as those described, e.g. by W. Siefken in Justus Liebigs Annalen de Chemie, 562, p. 75 to 136, e.g. 1,4-tetramethylene diisocyanate, 1,6-hexamethylene diisocyanate, 1,12-dodecane diisocyanate, cyclobutane 1,3-diisocyanate, cyclohexane 1,3-diisocyanate, cyclohexane 1,4-diisocyanate, 1-isocyanato-3,3,5-trimethyl-5-isocyanato-methylcyclohexane, 1,4- and 2,6-hexahydrotoluylene diisocyanate, hexahydro-1,3- and -1,4-phenylene diisocyanate, 1,3-phenylene diisocyanate, 1,4-phenylene disocyanate, diphenylmethane-2,4'- and/or 4,4'-diisocyanate, naphthylene 1,5-diisocyanate, mixtures of these and other polyisocyanates, polyisocyanates having carbodiimide groups (as described e.g. in DE 1092007), polyisocyanates having allophanate groups (as described e.g. in GB 994890), polyisocyanates having isocyanurate groups (as described e.g. in DE 1022789 and DE 1222067), polyisocyanates having urethane groups (as described e.g. in U.S. Pat. No. 3,394,164) or polyisocyanates prepared by reaction of at least one difunctional hydroxyl compound with excess of at least one difunctional isocyanate, polyisocyanates having biuret groups (as described e.g. in DE 1101394) and prepolymer or polymer substances having at least two isocyanate groups.

Examples of suitable polyisocyanate compounds are further given in the book High Polymers, Volume XVI dealing with "Polyurethanes, Chemistry and Technology", Interscience Publishers, New York, London, and further also in Volume I, 1962, p. 32–42 and 45–54 and Volume II, 1964, p. 5-6 and 198–199, and also in Kunststoffhandbuch (Handbook of Plastics), Volume VI, Vieweg-Höchtlen, Carl-Hanser Verlag, Munich, 1966, p. 45–71.

Particularly preferred polyisocyanates for preparing polyfunctional oxazolanes are low molecular weight (cyclo)aliphatic diisocyanates, e.g.: hexamethylene diisocyanate, isophorone diisocyanate, 4,4'-diisocyanatodicyclohexylmethane or relatively high molecular weight isocyanate prepolymers based on such diisocyanates.

According to a preferred embodiment in the formation of polyfunctional oxazolanes said preferred polyisocyanates are allowed to react with monooxazolanes according to the above-mentioned general formula (V) wherein nitrogen is linked to a $HO—CH_2—CH_2—$ group to form an urethane linkage, $R_5$ represents hydrogen, $R_6$ an ethyl-1-pentyl group, and $R_7$ is an ethylene group.

Polyepoxides suitable for use in the preparation of polyfunctional oxazolanes are organic compounds containing at least two epoxide groups.

Preferred polyepoxides for such use are aliphatic bisepoxides having epoxide equivalent weights of 43 to 300, e.g. 1,3-butadiene bisepoxide, 1,5-hexadiene bisepoxide, ethylene glycol diglycidyl ether, glycerol-1,3-diglycidyl ether, 3,4-epoxycyclohexyl, methyl-3',4'-epoxycyclohexane carboxylate, and adipic acid-(3,4-epoxycyclohexyl)-bisester.

Still other methods of preparing oxazolanes of relatively high functionality are described in the already mentioned U.S. Pat. No. 4,975,493.

The molecular weight and functionality of the oxazolanes of relatively high functionality may be adjusted readily through the choice of the reactants.

For use according to the present invention di- and/or trifunctional oxazolanes are applied preferably in conjunction with a copolymer of maleic anhydride and other monomers, e.g. styrene, methyl methacrylate and butyl acrylate, containing at least 10% by weight of polymerised maleic anhydride units.

The following illustrates in detail the preparation of specific components (A) and (B) suited for use according to the present invention.

I. Preparation of the maleic anhydride copolymers A

General procedure for preparing the maleic anhydride copolymers $A_1$–$A_9$ mentioned in Table 1 under the heading MSA-copolymers A:

Part I is introduced initially into a reaction vessel equipped with a stirring, cooling and heating system, heated to the reaction temperature. Part II is added over a period of 3 hours and part III over a period of 3,5 hours, followed by stirring for 2 hours.

The reaction temperatures and the composition of parts I–III are shown in the following Table 1 together with the solids content and viscosity of the maleic anhydride copolymer solutions obtained.

| | MSA-Copolymers A (Quantities in g) | | | | | | | | |
|---|---|---|---|---|---|---|---|---|---|
| | $A_1$ | $A_2$ | $A_3$ | $A_4$ | $A_5$ | $A_6$ | $A_7$ | $A_8$ | $A_9$ |
| Part I | | | | | | | | | |
| Butyl acetate | 1050 | 1534 | 1400 | | | 798 | 1670 | | 1500 |
| Methoxypropyl acetate | | | | 1200 | 800 | | | 1891 | |
| Xylene | | | | | | | 3300 | | |
| Part II | | | | | | | | | |
| Xylene | | | | | | | 1400 | | |
| Methyl methacrylate | 859 | 780 | 1025 | | 600 | 675 | 1080 | | 120 |
| Styrene | 313 | 180 | 341 | 450 | 30 | 350 | 3360 | 1013 | 870 |
| Butyl acrylate | 300 | 300 | 732 | 675 | 327.5 | 1056 | 4560 | 563 | 1410 |
| Glycidyl methacrylate | | 120 | | | | | | | |
| Maleic anhydride | 284 | 120 | 244 | 375 | 40 | 425 | 2400 | 300 | 480 |
| Hexanediol bisacrylate | | | | | 2.5 | | | | |
| Butyl acetate | | | | | | 1275 | 1000 | | 449 |
| n-Dodecylmercaptan | | | | | 10 | | | | |
| Part III | | | | | | | | | |
| AIBN | | | | 30 | 20 | | | | |

-continued

| | MSA-Copolymers A (Quantities in g) | | | | | | | | |
|---|---|---|---|---|---|---|---|---|---|
| | $A_1$ | $A_2$ | $A_3$ | $A_4$ | $A_5$ | $A_6$ | $A_7$ | $A_8$ | $A_9$ |
| Ditert.butyl peroxide | | | | | | | 600 | | |
| tert.-butyl peroctoate (70%) | 105 | 86 | 140 | | | 105 | | 233 | 171 |
| Xylene | | | | | | | 600 | | |
| Methoxypropyl acetate | | | | 330 | 200 | | | | |
| Butyl acetate | 360 | | 118 | | | | | | |
| Reaction temperature (°C.) | 115 | 120 | 120 | 130 | 120 | 126 | 150 | 145 | 125 |
| Solids content (%) | 55.2 | 50.0 | 60.4 | 55.7 | 40.6 | 56.4 | 60.0 | 49.3 | 59.5 |
| Viscosity (mPa.s) | 11100 | 900 | | 18700 | 576 | 1100 | 1100 | | 2100 |
| Anhydride equivalent weight (g) (theory) | 606 | 1225 | 941 | 392 | 2450 | 578 | 465 | 613 | 588 |

II. Preparation of blocked polyamines B

B 1) The bisketimine B1 is obtained from 680 g of isophoronediamine, 1000 g of methyl isobutyl ketone and 560 g of toluene after separation of 146 g of water (theoretical quantity: 144 g) at 120° C. and subsequent distillation.

B 2) 200 g of isobutyraldehyde and 133 g of cyclohexane are introduced under nitrogen atmosphere into a 1l reaction vessel equipped with stirring, cooling and heating means and the reaction mixture is cooled to 10° C. in an ice bath. Thereupon 176.6 g of 1-amino-3-(methylamino)-propane are slowly added dropwise and the reaction mixture is stirred at 10° C. for one hour. It is then heated to reflux temperature until 52 g of water have separated off. After removal of the solvent and unreacted blocking agent by distillation hexahydropyrimidine is obtained.

B 3) By transforming propionic anhydride and aminoethanol by refluxing in xylene under azeotropic elimination of the reaction water (H. L. Wehrmeister, J. Org. Chem., 26, 3821 (1961)) a monooxazoline as defined hereinafter by structural formula is obtained that is purified by distillation:

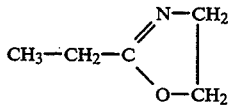

99 g of this monooxazoline, 88 g of ethylene carbonate and 0.4 g of lithium chloride are heated at 150° C. for 12 h. After distillation the colourless, bicyclic amidacetal B3 is obtained.

B 4) By transforming 528 g of 1-amino-3-methylaminopropane and 360 g of acetic acid in 99 g of toluene and elimination of the reaction water at 100° to 130° C. a tetrahydropyrimidine precursor is obtained (theor.: 216 g; found: 212.5 g), which after distillation is obtained in about 90% yield as a bright and colourless liquid.

112 g of tetrahydropyrimidine precursor are made to react in 200 g of butyl acetate with 87 g of ethylene glycol diglycidyl ether at 120° to 130° C. for 5 h. After adding charcoal the reaction mixture is stirred for still 1 h, and filtered off under nitrogen atmosphere. A yellow solution (about 50%) of the difunctional bicyclic amidaminal B4 is obtained.

Preparation of the oxazolanes B:

General procedure:

To prepare the oxazolanes, the hydroxyamines, the carbonyl compounds and, optionally, the entraining agent are mixed and 0.01 to 0.1% of an acidic catalyst is added optionally to the resulting mixture. The reaction mixture is then heated under reflux in an inert gas atmosphere (e.g. $N_2$, Ar) on a water separator until the theoretical quantity of water has separated off or until no more water separates off. The products thus obtained may be used for the combinations according to the invention without any further purification or separation step. When the purity or uniformity of the products has to meet particularly exacting requirements, the products may be purified, e.g. by vacuum distillation.

B 5) The oxazolane B5 is obtained from 210 g of diethanolamine, 158.4 g of isobutyraldehyde and 92.1 g of xylene after separation of 34.2 g of water (theoretical quantity: 36 g).

B 6) 536 g of trimethylolpropane, 1368 g of ε-caprolactone, 476 g of dimethyldiglycol and 0.4 g of an esterification catalyst (tin dioctoate) are heated together to 140° C. for 4 h. Thereupon 297,5 g of the trimethylolpropane/ε-caprolactone adduct thus prepared and 265.0 g oxazolane B5 are heated together to 50° C. After the dropwise addition of 252 g of hexamethylene diisocyanate, the mixture is stirred at 70° C. for 6 h. The polyoxazolane B6 is obtained in the form of a 70% solution after the addition of 113 g of dimethyl diglycol.

B 7) The oxazolane B7 is obtained from 210 g of diethanolamine, 281,6 g of 2-ethylhexanal and 122.9 g of cyclohexane after separation of 35 g of water (theoretical quantity:36 g).

B 8) 400 g of an aliphatic polyisocyanate containing biuret groups and based on hexamethylene diisocyanate and 397 g of methoxypropyl acetate are introduced into a 2-liter reaction vessel equipped with stirrer, condenser and heating device. After the dropwise addition of 526.1 g of the oxazolane of diethanolamine and 2-ethylhexanal described in B 7), the temperature of the reaction mixture is maintained at 70° C. for 11 h. An approximately 70% solution of B8 containing a statistical average of 3 oxazolane groups is obtained.

B 9)a) 296 g of phthalic anhydride, 324 g of cyclohexane dimethanol and 52 g of neopentyl glycol are weighed in a reaction vessel suitable for esterification under a nitrogen atmosphere and heated to 220° C. for 8 h. Water is separated until the acid number has reached or dropped below 2.5. The polyester precursor B9a is obtained.

145.2 g of the polyisocyanate described under the heading of B7 and 113.4 g of methoxypropyl acetate are weighed into a 1-liter reaction vessel equipped with stirrer, condenser and heating device and heated to 60° C. Thereupon 119.5 g of the oxazolane precursor obtained from diethanolamine and 2-ethylhexanal is then added dropwise and stirring is continued at 70° C. for 3 h. After the addition of 318.4 g of polyester precursor B 9 a, the temperature is maintained at 70° C. for 11 h and B9 which is a polyester-based polyoxazolane is then obtained as a 70% solution.

B 10) A polyoxazolane is prepared from 187.8 g of an isocyanurate polyisocyanate, which has been prepared by partial trimerisation of the NCO groups of hexamethylene diisocyanate in accordance with EP 10589 and which has an NCO content of 21.45% by weight, and 1623 g of oxazolane (obtained from 1728 g of methyl ethyl ketone and 2100 g of diethanolamine). The highly viscous product is dissolved in butyl acetate to from a 70% solution. The solution has a viscosity of 900 mPa.s at 23° C.

B 11) A polyoxazolane is prepared from 840 g of hexamethylene diisocyanate and 2360 g of oxazolane B7. The product has a viscosity of 4000 mPa.s at 23° C.

According to one embodiment of the present invention said moisture-curable mixture of the components (A) and (B) is used as binder in an image-receiving layer for use according to thermal dye sublimation transfer.

Together with the mixture of the components (A) and (B) other conventional binder resins for dye receiving layer can be used such as polyesters (e.g., as described in EP 481129 and EP 481130), solvent soluble polyesters such as VYLON supplied by Toyobo, DYNAPOL supplied by Huls Chemie and VITEL supplied by Goodyear, co-vinylchloride-vinylacetates such as VINYLITE and UCAR types VYNS-3, VYHH, VYHD and VYLF supplied by Union Carbide, polycarbonates, polyurethanes, styrene copolymers (e.g. co-styrene-acrylonitrile), polyamides, etc. Mixtures of these resins can also be used.

The total amount of binder used in the dye receiving layer of the present invention is from 25 to 95% by weight, preferably from 50 to 80% by weight.

The dye receiving element of the present invention can contain a release agent for improvement of the release property with respect to the donor element. As the release agent, solid waxes such as polyethylene wax, amide wax, and Teflon powder; fluorine based and phosphate ester based surfactants; and paraffin based, silicone based and fluorine based oils can be used. Silicone oils, preferably reactive silicone oils and silicone containing copolymers such as polysiloxane-polyether copolymers and blockcopolymers, are preferred (e.g. TEGOGLIDE supplied by Goldschmidt and SILWET supplied by Union Carbide.

High boiling organic solvents or thermal solvents or plasticizers can be included in the image-receiving layer, as substances which can accept or dissolve the dyes or as diffusion promotors for the dyes. Useful examples of such high boiling organic solvents and thermal solvents include the compounds disclosed in, for example, JP 62/174754, JP 62/245253, JP 61/209444, JP 61/200538, JP 62/8145, JP 62/9348, JP 62/30247, JP 62/136646.

For the purpose of improving the whiteness of the receiving layer to enhance sharpness of the transferred image and also imparting writability to the receiving surface as well as preventing retransfer of the transferred image, a white pigment can be added to the receiving layer. As white pigment, titanium oxide, zinc oxide, kaolin, clay, calcium carbonate, fine powdery silica, etc. can be employed, and these can be used as a mixture of two or more kinds as described above.

Also, for further enhancing the light resistance of the transferred image, one or two or more kinds of additives such as UV-ray absorbers, light stabilizers and antioxidants, can be added, if necessary. The amounts of these UV-ray absorbers and light stabilizers is preferably 0.05 to 10 parts by weight and 0.5 to 3 parts by weight, respectively, per 100 parts of the resin constituting the receiving layer.

In the preparation of the dye-image receiving layer according to the present invention a mixture of components (A) and (B) is made in a water-free organic solvent or solvent mixture and optionally other binder resins and other additives are dispersed therein to form a composition ready for coating. The solvent(s) are used in a quantity necessary to obtain the required coating composition viscosity adapted to the applied coating system. The quantity of solvent may be kept fairly small by applying low molecular weight maleic anhydride copolymers.

According to a particular embodiment dispensing with solvent removal after coating, a liquid monomer or mixture of monomers is used that acts as solvent for the applied components (A) and (B). Said monomer or mixture of monomers, which has not to be removed by evaporation, can be polymerised at elevated temperature in the presence of a thermally activatable radical former for addition polymerisation.

The hardening of the binder obtained by reaction of components (A) and (B) proceeds quickly in the presence of atmospheric moisture entering the coating after its application. The hardening may be accelerated by heat e.g. in the temperature range of 40° to 130 ° C., temperature at which applied solvents are removed by evaporation.

According to a special embodiment said components (A) and (B) are used in combination with reagents that split off water on heating, e.g. in a polycondensation reaction of (poly)carboxylic acids with polyols, e.g. polyester prepolymers having terminal hydroxyl groups, vinyl alcohol copolymers, partially esterified cellulose, and/or polyoxyalkylene compounds, or hygroscopic compounds and/or pigments.

According to another embodiment of the present invention said moisture-curable mixture of the components (A) and (B) is used as binder in a layer provided on top of the image receiving layer. Said toplayer generally also comprises a release agent of the type described above, e.g. a polysiloxanepolyether copolymer.

As the support for the receiver sheet it is possible to use a transparent film or sheet of various plastics such as polyethylene terephthalate, polyolefin, polyvinyl chloride, polystyrene, polycarbonate, polyether sulfone, polyimide, cellulose ester or polyvinyl alcohol-co-acetal. Blue-colored polyethylene terephthalate film can also be used. The support may also be a reflective support such as paper e.g. top quality paper, art paper, cellulose fiber paper; baryta-coated paper; polyolefin-coated paper e.g. dual polyethylene-coated paper; synthetic paper e.g. polyolefin type, polystyrene type or white polyester type i.e. white-pigmented polyester.

Also, a laminated product by any desired combination of the above can be used. Typical examples of the laminates include a laminate of cellulose fiber paper and synthetic paper and a laminate of cellulose fiber paper and a plastic film or sheet. As further examples of the laminates, a plastic film can be used with synthetic paper instead of cellulose fiber paper. Further, a laminate of cellulose fiber paper, plastic film and synthetic paper can also be used.

The support sheet serves to support the dye receiving layer, and it is desirable that the support sheet has mechanical strength sufficient enough to handle the dye receiving sheet which is heated at the time of heat transfer recording. If the dye-receiving layer alone has the necessary mechanical strength, the support sheet may be omitted.

The dye-receiving layer :of the present invention preferably has an overall thickness of from 0.5 to 50 μm, more preferably from 2.5 to 10 μm when the dye-receiving layer is provided on a support sheet, or preferably from 3 to 120 μm when it is self-supporting i.e. a support sheet is omitted.

The image receiving layer may be a single layer, or two or more such layers may be provided on the support.

Also receiving layers may be formed on both surfaces of the support. In the case of a transparent support recto-verso printing on both receiving layers as described in EP 452566 then leads to an increase in density of the transferred image.

In case a toplayer is provided the thickness of such a toplayer is preferably 0.01 to 5 μm, particularly 0.05 to 2 μm.

The image receiving element of the present invention may also have one or more intermediate layers between the support and the image receiving layer. Depending on the material from which they are formed, the intermediate layers may function as cushioning layers, porous layers or dye diffusion preventing layers, or may fulfill two or more of these functions, and they may also serve the purpose of an adhesive, depending on the particular application.

The material constituting the intermediate layer may include, for example, an urethane resin, an acrylic resin, an ethylenic resin, a butadiene rubber, or an epoxy resin. The thickness of the intermediate layer is preferably from 1 to 20 μm.

Dye diffusion preventing layers are layers which prevent the dye from diffusing into the support. The binders used to form these layers may be water soluble or organic solvent soluble, but the use of water soluble binders is preferred, and especially gelatin is most desirable.

Porous layers are layers which prevent the heat which is applied at the time of thermal transfer from diffusing from the image receiving layer to the support to ensure that the heat which has been applied is used efficiently.

Fine powders consisting of silica, clay, talc, diatomaceous earth, calcium carbonate, calcium sulfate, barium sulfate, aluminum silicate, synthetic zeolites, zinc oxide, lithophone, titanium oxide or alumina for example, can be included in the image receiving layers, cushioning layers, porous layers, diffusion preventing layers and adhesive layers, etc. constituting the thermal transfer image receiving element of the present invention.

Also, the image receiving element of the present invention can have antistatic treatment applied to the front or back surface thereof. Such antistatic treatment may be carried out by incorporating an antistatic agent in, for example, the image receiving layer which becomes the front surface or in an antistatic preventive layer applied to the image receiving surface. A similar treatment can also be effected to the back surface. By such treatment, mutual sliding between the image receiving sheets can be smoothly performed, and there is also the effect of preventing the attachment of dust on the image receiving sheet.

Furthermore, the image receiving sheet can have a lubricating layer provided on the back surface of the sheet support. The material for the lubricating layer may include methacrylate resins such as methyl methacrylate, etc. or corresponding acrylate resins, vinyl resins such as vinyl chloride-vinyl acetate copolymer.

The receiving element can have detection marks provided on'one surface, preferably the back surface so that the receiving element can be accurately set at a desired position during transfer, whereby the image can be formed always at a correct desired position.

A dye-donor element for use according to thermal dye sublimation transfer in combination with the present receiving element usually comprises a very thin support e.g. a polyester support, one side of which is covered with a dye layer, which contains the printing dyes. Usually an adhesive or subbing layer is provided between the support and the dye layer. Normally the opposite side is covered with a slipping layer that provides a lubricated surface against which the thermal printing head can pass without suffering abrasion. An adhesive layer may be provided between the support and the slipping layer.

The dye layer can be a monochrome dye layer or it may comprise sequential repeating areas of different colored dyes like e.g. of cyan, magenta, yellow and optionally black hue. When a dye-donor element containing three or more primary color dyes is used, a multicolor image can be obtained by sequentially performing the dye transfer process steps for each color.

The dye layer of such a thermal dye sublimation transfer donor element is formed preferably by adding the dyes, the polymeric binder medium, and other optional components to a suitable solvent or solvent mixture, dissolving or dispersing the ingredients to form a coating composition that is applied to a support, which may have been provided first with an adhesive or subbing layer, and dried.

The dye layer thus formed has a thickness of about 0.2 to 5.0 μm, preferably 0.4 to 2.0 μm, and the ratio of dye to binder is between 9:1 and 1:3 by weight, preferably between 2:1 and 1:2 by weight.

As polymeric binder the following can be used: cellulose derivatives, such as ethyl cellulose, hydroxyethyl cellulose, ethyl hydroxy cellulose, ethyl hydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic. Preferably cellulose acetate butyrate or copolystyrene-acrylonitrile(-butadieen) is used as binder for the dye layer.

Any dye can be used in such a dye layer provided it is easily transferable to the dye-image-receiving layer of the receiver sheet by the action of heat.

Typical and specific examples of dyes for use in thermal dye sublimation transfer have been described in, e.g., EP 453020, EP 209990, EP 209991, EP 216483, EP 218397, EP 227095, EP 227096, EP 229374, EP 235939, EP 247737, EP 257577, EP 257580, EP 258856, EP 279330, EP 279467, EP 285665, EP 400706, U.S. Pat. Nos. 4,743,582, 4,753,922, 4,753,923, 4,757,046, 4,769,360, 4,771,035, JP 84/78894, JP 84/78895, JP 84/78896, JP 84/227490, JP 84/227948, JP 85/27594, JP 85/30391 , JP 85/229787, JP 85/229789, JP 85/229790, JP 85/229791, JP 85/229792, JP 85/229793, JP 85/229795, JP 86/41596, JP 86/268493, JP 86/268494, JP 86/268495 and JP 86/284489.

The coating layer may also contain other additives, such as curing agents, preservatives, organic or inorganic fine particles, dispersing agents, anti static agents, defoaming agents, viscosity controlling agents, etc., these and other ingredients being described more fully in EP 133011, EP 133012, EP 111004 and EP 279467.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a polyethylene terephthalate support. In general, the support has a thickness of 2 to 30 μm. The support may also be coated with an adhesive or subbing layer, if desired.

The dye layer of the dye-donor element may be coated on the support or printed thereon by a printing technique such as a gravure process.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacryl amide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/-subbing layers.

Preferably the reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layers are described in e.g. EP 138483, EP 227090, U.S. Pat. Nos. 4,567,113, 4,572,860, 4,717,711. Preferably the slipping layer comprises as binder a styrene-acrylonitrile copolymer or a styrene-acrylonitrile-butadiene copolymer or a mixture thereof and as lubricant in an amount of 0.1 to 10% by weight of the binder (mixture) a polysiloxane-polyether copolymer or polytetrafluoroethylene or a mixture thereof.

The dye layer of the dye-donor element may also contain a releasing agent that aids in separating the dye-donor element from the dye-receiving element after transfer. The releasing agents can also be applied in a separate layer on at least part of the dye layer. For the releasing agent solid waxes, fluorine- or phosphate-containing surfactants and silicone oils are used. Suitable releasing agents are described in e.g. EP 133012, JP 85/19138, EP 227092.

The dye-receiving elements according to the invention are used to form a dye transfer image. Such a process comprises placing the dye layer of the donor element in face-to-face relation with the dye-receiving layer of the receiver sheet and imagewise heating from the back of the donor element. The transfer of the dye is accomplished by heating for about several milliseconds at a temperature of 400° C.

When the process is performed for but one single color, a monochrome dye transfer image is obtained. A multicolor image can be obtained by using a donor element containing three or more primary color dyes and sequentially performing the process steps described above for each color. The above sandwich of donor element and receiver sheet is formed on three occasions during the time when heat is applied by the thermal printing head. After the first dye has been transferred, the elements are peeled apart. A second dye-donor element (or another area of the donor element with a different dye area) is then brought in register with the dye-receiving element and the process repeated. The third color and optionally further colors are obtained in the same manner.

In order to accomplish a perfect register when the process is performed for more than one color and in order to detect what color is existing at the printing portion of the donor element, detection marks are commonly provided on one surface of the donor element. Generally optically detectable marks are used that can be detected by a light source and a photo sensor; detection can be done by measuring the light transmitted through the detection mark or reflected from said mark. The marks being in the form of a light-absorbing or light-reflecting coating are formed in a preassigned position on the donor element by e.g. gravure printing. The detection marks can comprise an infrared absorbing compound such as carbon black. The detection mark can also comprise one of the image dyes that are used for the image formation, with the detection being in the visible range.

In addition to thermal heads, laser light, infrared flash or heated pens can be used as the heat source for supplying heat energy. Thermal printing heads that can be used to transfer dye from the dye-donor elements of the present invention to a receiver sheet are commercially available. In case laser light is used, the dye layer or another layer of the dye element has to contain a compound that absorbs the light emitted by the laser and converts it into heat, e.g. carbon black.

Alternatively, the support of the dye-donor element may be an electrically resistive ribbon consisting of, for example, a multi-layer structure of a carbon loaded polycarbonate coated with a thin aluminum film. Current is injected into the resistive ribbon by electrically adressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

The following examples are provided to illustrate the invention in more detail without limiting, however, the scope thereof.

EXAMPLE 1

A polyethylene terepthalate film of 175 μm provided with a conventional subbing layer was coated with a composition for forming the receiving layer comprising in amounts as indicated in table 2 below the maleic anhydride copolymer A7 (table 1), poly(vinylchloride-co-vinylacetate-co-vinylalcohol) (90/4/6 wt %) (sold under the tradename VINYLITE VAGD by Union Carbide), the oxazolane compound BB, and optionally as releasing agent a polysiloxane polyether copolymer sold under the tradename TEGOGLIDE 410 by Th. Goldschmidt AG, D-4300 Essen 1, Germany. After coating the layer was dried at 120° C. during 5 minutes and subsequently stored during 16 hours at room temperature and normal relative humidity.

A commercially available Mitsubishi material type CK 100TS was used as dye donor element.

The obtained dye receiving element was printed in combination with the dye-donor element in a Mitsubishi video printer type CP 100E.

The receiver sheet was separated from the dye-donor element and the release property of the receiving layer was evaluated qualitatively by the ripping out of parts of the dye layer from the donor element by the receiving element after transfer was effected. Rating 0 indicates no delamination; rating 1 indicates very little delamination; rating 2 indicates little delamination; rating 3 indicates strong delamination. In the case of rating 3 large portions of the dye layer are ripped out from the donor element and stick to the printed receiver element.

The results are listed in table 2 below. The amounts are indicated in g/m$^2$.

TABLE 2

| No. | VINYLITE | A7 | B8 | TEGOGLIDE | rating |
|---|---|---|---|---|---|
| 1 | 3 | / | / | / | 3 |
| 2 | 3 | / | / | 0.05 | 3 |
| 3 | 3 | 0.75 | 0.25 | / | 0 |
| 4 | 3 | 0.75 | 0.25 | 0.05 | 0 |
| 5 | 2 | 1.5 | 0.5 | 0.05 | 0 |

The above results show that the releasability of the receiving element is improved by using a composition according to the present invention as receiving layer.

The thus obtained receiving elements show good dyeability and image quality.

EXAMPLE 2

A polyethylene terephthalate film of 175 μm that may be provided with a conventional subbing layer is coated with a composition for forming the receiving layer comprising a conventional polyester dye-receiving resin (a polyester comprising terepthalic acid (22.5 mole %), isopthalic acid (15 mole %), sulfoisophthalic acid sodium salt (7.5 mole %), docosenylsuccinic acid (5 mole %), ethylene glycol (40 mole %), ethoxylated bisphenol A (10 mole %)) dispersed in water at a coverage of 4 g polyester per m$^2$.

Subsequently a composition for forming the toplayer comprising in amounts as indicated in table 3 below the compounds A7 and B8 and a silicone type release agent (TEGOGLIDE 410) in ethylacetate was applied to this receiving layer.

The thus obtained dye-receiving element was dried at 120° C. for 5 minutes and stored for 16 hours at room temperature and normal relative humidity.

Image receiving elements comprising the compounds identified in table 3 below were prepared in this manner. The amounts are indicated in g/m$^2$.

The receiving elements are printed and evaluated in an analoguous manner as indicated in example 1 above.

TABLE 3

| No. | A7 | B8 | TEGOGLIDE | rating |
|---|---|---|---|---|
| 6 | / | / | 0.05 | 2 |
| 7 | 0.375 | 0.125 | 0.05 | 0 |
| 8 | 0.75 | 0.25 | 0.05 | 0 |

The above results show that the releasability of the receiving element is improved by using a composition according to the present invention as toplayer.

We claim:

1. A thermal dye sublimation transfer system comprising:

(1) a dye-donor element comprising on a support a dye layer comprising a thermal-transferable dye and a polymeric binder, and (2) a dye-image receiving element for use in combination with said dye-donor element;

said dye-image receiving element comprising a support having thereon a dye-image receiving layer comprising the cured product of a moisture-curable binder composition, characterized in that said moisture-curable binder composition is prepared by mixing the following components (A) and (B):

(A) 30 to 99 parts by weight of at least one copolymer of olefinically unsaturated compounds having a weight-average molecular weight (Mw) of at least 1500 and containing chemically incorporated moieties capable of undergoing an addition reaction with amino groups, and (B) 1 to 70 parts by weight of organic substances containing blocked amino groups from which substances under the influence of moisture compounds having free primary and/or secondary amino groups are formed, wherein i) the copolymers of component (A) contain intra-molecularly bound carboxylic anhydride moieties, with the anhydride equivalent weight of the copolymers being from 196 to 9800 and ii) the binder composition contains from 0.25 to 10 anhydride moieties for each blocked amino group.

2. The thermal dye sublimation transfer system according to claim 1, wherein said component (A) consists essentially of a copolymer of:

a) 3 to 25 parts by weight of maleic anhydride, and b) 75 to 97 parts by weight of at least one copolymerisable monomer selected from the group corresponding to the following general formulae (I), (II) and (III):

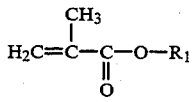

(I)

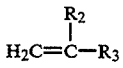

(II)

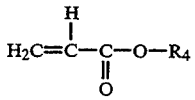

(III)

wherein:

each of $R_1$ and $R_4$ independently of each other represents an aliphatic or cycloaliphatic $C_1$–$C_{22}$ hydrocarbon group in which one or more carbon atoms may be replaced by heteroatoms selected from the group consisting of oxygen, sulphur and nitrogen; a fluoroalkyl group; a perfluoroalkyl group or a polydialkylsiloxane group;

$R_2$ represents hydrogen, methyl, ethyl, chlorine, fluorine or an alkoxy group;

$R_3$ represents a $C_2$–$C_{22}$ aliphatic hydrocarbon group; a $C_5$–$C_{10}$ cycloaliphatic hydrocarbon group; a $C_6$–$C_{12}$ aromatic hydrocarbon group (including an aryl aliphatic group) and in each of these three hydrocarbon groups (aliphatic, cycloaliphatic and aromatic) possibly one or more carbon atoms may be replaced by heteroatoms selected from the group consisting of oxygen, sulphur and nitrogen in the form of ether, ester, amide, urethane, urea, thioester, oxirane, ketone, lactam or lactone group; a fluoroalkyl group; a perfluoroalkyl group; a polydialkylsiloxane group; a nitrile group; chlorine; and wherein component (B) is a compound selected from the group consisting of an aldimine, ketimine, oxazolane, hexahydropyrimidine, tetrahydropyrimidine, tetrahydroimidazole, amide acetal and amide aminal.

3. The thermal dye sublimation transfer system according to claim 1, wherein said copolymers (A) have a weight-average molecular weight determined by gel chromatography of 3000 to 50000, and their anhydride equivalent weight (=quantity in gram containing 1 mole of anhydride groups) is from 3800 to 393.

4. The thermal dye sublimation transfer system according to claim 1, wherein said copolymers (A) contain styrene, methacrylate and/or acrylate units.

5. The thermal dye sublimation transfer system according to the claim 1, wherein component (B) has a molecular weight of from 86 to 10000 and contains a statistical average of from 1 to 50 structural units corresponding to at least one of the following general formulae (IV), (V), (VI), (VII) and (VIII):

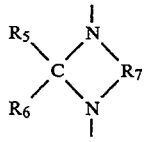

IV

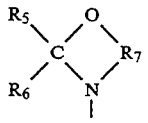

V

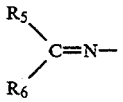

VI

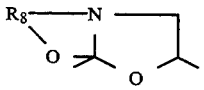

VII

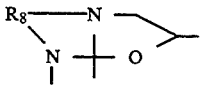

VIII wherein:

each of $R_5$ and $R_6$ independently of each other represents hydrogen, an aliphatic hydrocarbon group containing from 1 to 18 carbon atoms, a cycloaliphatic hydrocarbon group containing from 5 to 10 carbon atoms, an araliphatic hydrocarbon group containing from 7 to 18 carbon atoms or a phenyl group, or $R_5$ and $R_6$ represent together the necessary atoms to form a five- or six- membered cycloaliphatic ring with the carbon atom whereto they are commonly linked;

$R_7$ represents a divalent aliphatic hydrocarbon group containing 2 to 6 carbon atoms, but having only a chain of 2 to 3 carbon atoms between the defined heteroatoms of the ring:

$R_8$ represents a divalent aliphatic hydrocarbon group having 2 to 10 carbon atoms, but having only 2 or 3 carbon atoms between the heteroatoms whereto said group is linked.

6. The thermal dye sublimation transfer system according to claim 5, wherein component (B) is a polyoxazolane obtained by allowing to react a mono-oxazolane according to said general formula (V) through hydrogen on its nitrogen atom with a polyfunctional reactant selected from the group consisting of a polyisocyanate, polyepoxide, polycarboxylic acid, partially esterified polycarboxylic acid or polycarboxylic acid.

7. The thermal dye sublimation transfer system according to claim 6, wherein said polyisocyanate is an aliphatic, cycloaliphatic, araliphatic, aromatic or heterocyclic polyisocyanate.

8. The thermal dye sublimation transfer system according to claim 1 wherein the dye-image receiving layer further comprises a thermoplastic resin or a heat-cured or radiation-cured resin as binder and a release agent.

9. A thermal dye sublimation transfer system comprising:

(1) a dye-donor element comprising on a support a dye layer comprising a thermal-transferable dye and a polymeric binder, and (2) a dye-image receiving element for use in combination with said dye-donor element;

said dye-image receiving element comprising a support having thereon in the order given a dye-image receiving layer and a top layer, said top layer comprising the cured product of a moisture-curable binder composition, characterized in that said moisture-curable binder composition is prepared by mixing the following components (A) and (B):

(A) 30 to 99 parts by weight of at least one copolymer of olefinically unsaturated compounds having a weight-average molecular weight (Mw) of at least 1500 and containing chemically incorporated moieties capable of undergoing an addition reaction with amino groups, and (B) 1 to 70 parts by weight of organic substances containing blocked amino groups from which substances under the influence of moisture compounds having free primary and/or secondary amino groups are formed, wherein i) the copolymers of component (A) contain intra-molecularly bound carboxylic anhydride moieties, with the anhydride equivalent weight of the copolymers being from 196 to 9800 and ii) the binder composition contains from 0.25 to 10 anhydride moieties for each blocked amino group.

10. The thermal dye sublimation transfer system according to claim 9, wherein said toplayer comprises a release agent.

* * * * *